US008348610B1

(12) United States Patent
Wilson

(10) Patent No.: US 8,348,610 B1
(45) Date of Patent: Jan. 8, 2013

(54) CEILING FAN BLADE COVERING SYSTEM

(76) Inventor: Bradley W. Wilson, Fortville, IN (US)

( * ) Notice: Subject to any disclaimer, the term of this patent is extended or adjusted under 35 U.S.C. 154(b) by 639 days.

(21) Appl. No.: 12/566,103

(22) Filed: Sep. 24, 2009

(51) Int. Cl.
*F04D 29/70* (2006.01)

(52) U.S. Cl. ..... 416/5; 416/62

(58) Field of Classification Search ..... 416/5, 62
See application file for complete search history.

(56) References Cited

U.S. PATENT DOCUMENTS 4,596,585 A * 6/1986 Moeller et al. ..... 95/57
4,676,721 A * 6/1987 Hardee ..... 416/146 R
D306,198 S 2/1990 Matherne
5,281,093 A * 1/1994 Sedlak et al. ..... 416/62
5,370,721 A 12/1994 Carnahan
5,562,412 A 10/1996 Antonelli
6,779,976 B1 8/2004 Carfagna et al.
8,025,481 B2 * 9/2011 Foxworth ..... 416/62
2003/0228220 A1 * 12/2003 White ..... 416/62
2004/0086386 A1 5/2004 Steinheiser
2004/0141848 A1 * 7/2004 Beaven ..... 416/247 R
2006/0067831 A1 3/2006 Graves et al.

* cited by examiner

*Primary Examiner* — Igor Kershteyn

(57) ABSTRACT

A ceiling fan blade covering system includes a ceiling fan that includes a plurality of fan blades. A plurality of coverings is provided. Each of the blades has one of the coverings positioned thereon. The coverings include a sleeve that has an open end, a closed end and a perimeter wall. An associated one of the blades is extended into the open end. The sleeve is comprised of a cloth material that is statically charged.

4 Claims, 2 Drawing Sheets

CEILING FAN BLADE COVERING SYSTEM

BACKGROUND OF THE DISCLOSURE

Field of the Disclosure

The disclosure relates to fan blade covering devices and more particularly pertains to a new fan blade covering device for removing dust from the air of a room.

SUMMARY OF THE DISCLOSURE

An embodiment of the disclosure meets the needs presented above by generally comprising a ceiling fan that includes a plurality of fan blades. A plurality of coverings is provided. Each of the blades has one of the coverings positioned thereon. The coverings include a sleeve that has an open end, a closed end and a perimeter wall. An associated one of the blades is extended into the open end. The sleeve is comprised of a cloth material that is statically charged.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
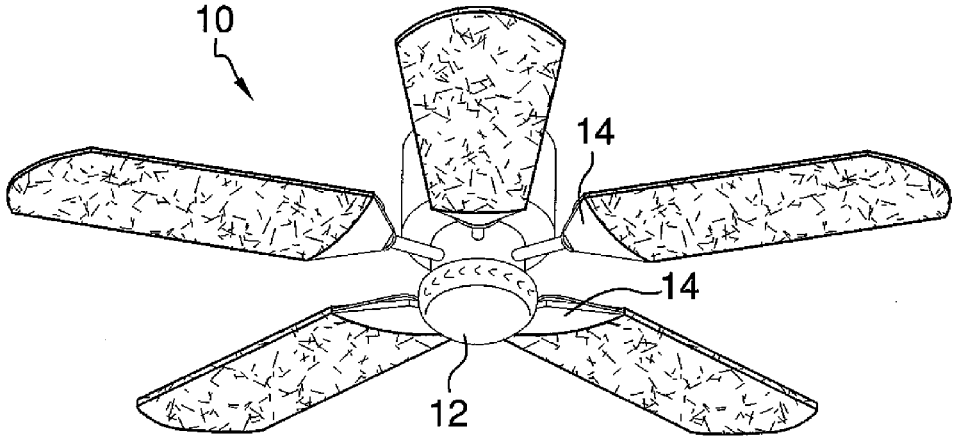
FIG. 1 is an in-use bottom perspective view of a ceiling fan blade covering system according to an embodiment of the disclosure.
Figure 2:
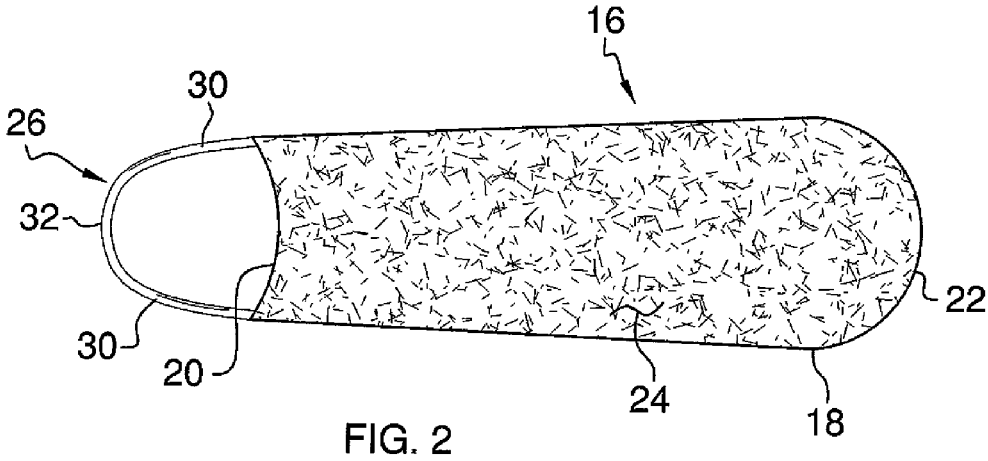
FIG. 2 is a bottom view of an embodiment of the disclosure.
Figure 3:
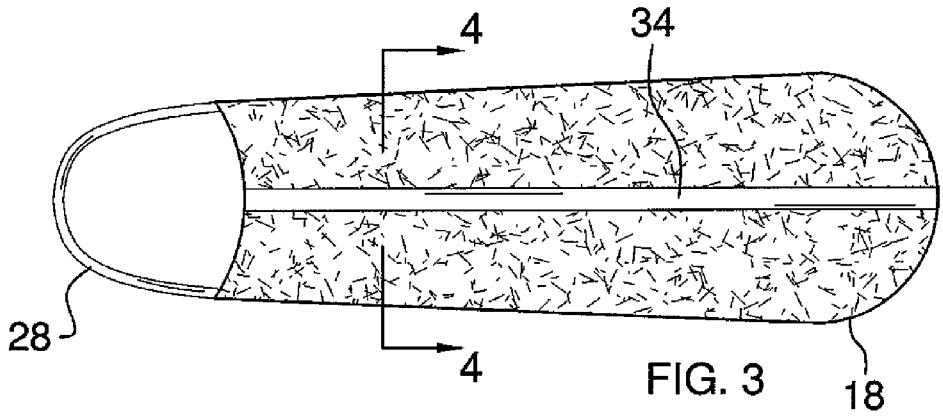
FIG. 3 is a top view of an embodiment of the disclosure.
Figure 4:
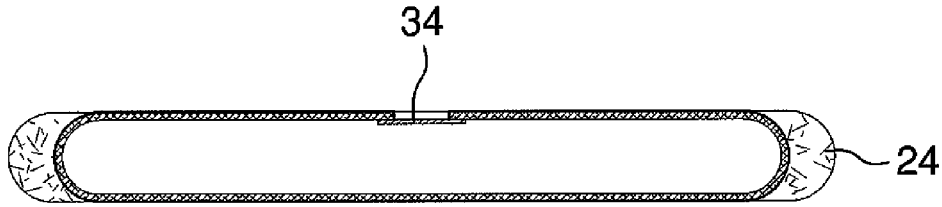
FIG. 4 is a cross-sectional view taken along line 4-4 of FIG. 3 of an embodiment of the disclosure.

With reference now to the drawings, and in particular to FIGS. 1 through 5 thereof, a new fan blade covering device embodying the principles and concepts of an embodiment of the disclosure and generally designated by the reference numeral 10 will be described.

As best illustrated in FIGS. 1 through 5, the ceiling fan blade covering system 10 generally comprises a conventional ceiling fan 12 that includes a plurality of fan blades 14.

A plurality of coverings 16 is provided. Each of the blades 14 has one of the coverings 16 positioned thereon. Each of the coverings 16 includes a sleeve 18 that has an open end 20, a closed end 22 and a perimeter wall 24 that extends between the closed 22 and open 20 ends. An associated one of the blades 14 is extended into the open end 20. The sleeve 18 is comprised of a cloth material that is statically charged. The cloth material is impregnated with a fragrance.

Figure 5:
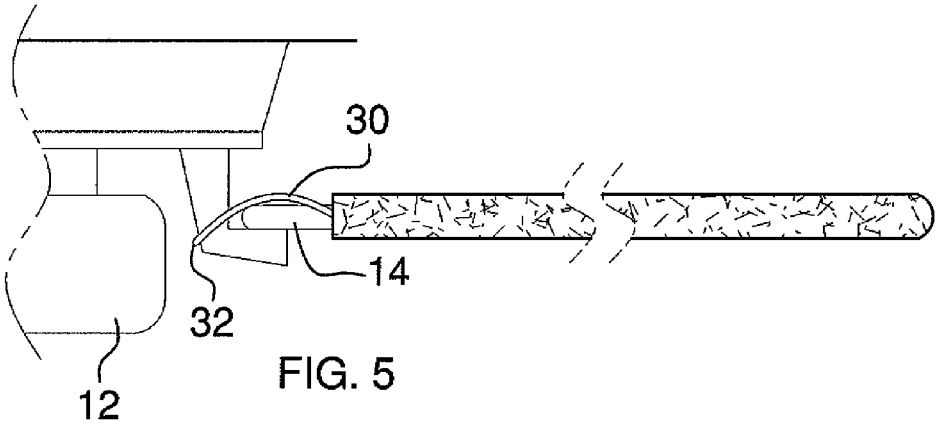
FIG. 5 is a broken side view of an embodiment of the disclosure.

A coupler 26 is attached to the sleeve 16. The coupler 26 releasably couples the sleeve 16 to the associated one of the blades 14. The coupler 26 comprises a band 28 positioned adjacent to the open end 20 and is extended around a portion of the associated one of the blades 14. The band 28 may be resiliently stretchable. The band 28 includes a pair of arms 30 and a central member 32 attached to the arms 30. The arms 30 are extendable over the edges of the fan blade 14 as shown in FIG. 5 while the central member 32 is abutted against a coupling bracket or arm of the fan blade 14.

An elastic strip 34 may be attached to the sleeve 16 and extend from the open end 20 to the closed end 22. The elastic strip 34 pulls the open end 20 toward the closed end 22 to retain the band 30 in a tight configuration to prevent the sleeve 16 from falling off the associated fan blade 14.

In use, the coverings 16 attract dust and other fine particles floating in the air to clean the air. The fragrance is dispensed from the coverings 16 to assist in freshening the air in the room where the ceiling fan 12 is located. The coverings 16 are removed and replaced as they become covered with dust or their fragrance is diminished.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A blade covering system comprising:

a ceiling fan including a plurality of fan blades;

a plurality of coverings, each of said blades having one of said coverings positioned thereon, each of said coverings including;

a sleeve having an open end, a closed end and a perimeter wall, an associated one of said blades being extended into said open end, said sleeve being comprised of a cloth material, said cloth material being statically charged; and a coupler being attached to said sleeve, said coupler releasably coupling said sleeve to the associated one of said blades, wherein said coupler comprises a band positioned adjacent to said open end, said band having opposite ends coupled to said sleeve on opposite sides of said open end, said band being extendable around a portion of the associated one of said blades.

2. A blade covering system comprising:

a ceiling fan including a plurality of fan blades;

a plurality of coverings, each of said blades having one of said coverings positioned thereon, each of said coverings including;

a sleeve having an open end, a closed end and a perimeter wall, an associated one of said blades being extended into said open end, said sleeve being comprised of a cloth material, said cloth material being statically charged, said cloth material being impregnated with a fragrance;

a coupler being attached to said sleeve, said coupler releasably coupling said sleeve to the associated one of said blades, said coupler comprising a band positioned adjacent to said open end, said band having opposite ends coupled to said sleeve on opposite sides of said open end, and said band being extended around a portion of the associated one of said blades.

3. A fan blade covering including:

a sleeve having an open end, a closed end and a perimeter wall, wherein a fan blade attached to a ceiling fan is extendable into said open end, said sleeve being comprised of a cloth material, said cloth material being statically charged; and a coupler being attached to said sleeve, said coupler releasably coupling said sleeve to the fan blade, wherein said coupler comprises a band positioned adjacent to said open end, said band having opposite ends coupled to said sleeve on opposite sides of said open end, said band being extendable around a portion of the fan blade.

4. The covering according to claim 3, wherein said cloth material is impregnated with a fragrance.

* * * * *